United States Patent [19]

Weckherlen et al.

[11] Patent Number: 4,930,230

[45] Date of Patent: Jun. 5, 1990

[54] APPARATUS FOR THE CONDITIONING OF BULK MATERIAL

[75] Inventors: Werner Weckherlen, Weinstadt; Hans-Joachim Dellit, Remshalden; Hans-Georg Gruene, Esslingen, all of Fed. Rep. of Germany

[73] Assignee: Schwaebische Huetten-Werke GmbH, Aalen-Wasseral-fingen, Fed. Rep. of Germany

[21] Appl. No.: 303,335

[22] Filed: Jan. 30, 1989

[30] Foreign Application Priority Data

Jan. 28, 1988 [DE] Fed. Rep. of Germany .....3802489

[51] Int. Cl.[5] ..... F26B 11/02

[52] U.S. Cl. ..... 34/168; 34/57 A; 239/110; 239/601

[58] Field of Search ..... 34/57 A, 57 B, 57 C, 34/168, 170, 10; 239/110, 558, 596, 601

[56] References Cited

U.S. PATENT DOCUMENTS

| | | | |
|---|---|---|---|
| 1,574,210 | 2/1926 | Spaulding | 34/170 |
| 3,257,733 | 6/1966 | Ives et al. | 34/170 |
| 3,666,117 | 5/1972 | Gessler | 214/17 D |
| 3,804,581 | 4/1974 | Schmalfeld et al. | 34/57 A |
| 4,114,289 | 9/1978 | Boulet | 34/168 |

*Primary Examiner*—Henry A. Bennet
*Assistant Examiner*—John Sollecito
*Attorney, Agent, or Firm*—Foley & Lardner, Schwartz, Jeffery, Schwaab, Mack, Blumenthal & Evans

[57] ABSTRACT

An apparatus for the conditioning of bulk material, in particular vegetable material such a wood chips, for the production of fibers or pulp is provided, comprising a silo, a plurality of steam nozzles distributed substantially uniformly over said silo and shielded against clogging with said bulk material, and a plurality of fittings disposed within said silo for relieving said bulk material. The apparatus provides substantially uniform conditioning of the bulk material.

20 Claims, 4 Drawing Sheets

APPARATUS FOR THE CONDITIONING OF BULK MATERIAL

BACKGROUND OF THE INVENTION

The invention relates to an apparatus for conditioning of bulk material, such as shavings or chips, especially of the vegetable type, such as wood-chips, for the production of fibers or pulp for making paper or cardboard or making fiberboards.

It is known to produce the pulp necessary for papermaking by a process in which wood chips or other vegetable substances are used. These wood chips, which can be approximately 20 to 40 mm long and up to approximately 20 mm wide, are defibered, so as then to be processed further in the appropriate way. To achieve as high a fiber quality as possible, the wood chips can be conditioned in a silo by means of low-pressure or high pressure steam.

The conditioned bulk material is discharged by means of a clearing unit through one or more orifices provided in the silo bottom, via screw conveyors, and is delivered to the defibration mill. During interruptions in operation, for example, during operating faults and the like, blockages in the silo occur as a result of the swelling of the wood-chips. Such agglomerations can be eliminated only by knocking, poking, etc. Moreover, the bulk material tends to form bridges, with a result that the discharge of the material from the silo becomes irregular and can even be blocked completely. Also, the temperature of the wood-chips is uneven and is unsatisfactory in view of the subsequent process steps. Considerable steam losses occur as a result of the formation of bridges and channels in the bulk material. Another disadvantage is that, because of the irregular steam distribution or varying retention time, the wood-chips change irregularly and their properties are thereby impaired, so that during subsequent use problems of quality can arise and additional costs are incurred.

SUMMARY OF THE INVENTION

Accordingly, it is the object of the present invention to provide an apparatus for the conditioning of bulk material, especially vegetable material such as wood-chips, for the production of fibers or pulp for making paper, cardboard or fiberboards, which produces substantially uniform conditioning of the bulk material by simple means.

In accomplishing the foregoing objective, there has been provided, in accordance with one aspect of the present invention, an apparatus comprising a silo, a bottom defined within said silo and having at least one orifice, a clearing unit disposed within said silo, at least one discharge device, a plurality of steam feed lines comprising steam nozzles attached to said silo at various locations on said silo and shielded against bulk material present within said silo, and a plurality of fittings for relieving said bulk material mounted within said silo. Said steam nozzles are preferably provided with inspection orifices which allow removal of impurities within said nozzles. In a preferred embodiment the apparatus further comprises an impregnation station for additional treatment of the bulk material, comprising a cross-conveyor and an impregnating screw conveyor within which is contained an impregnating liquid.

Because relief devices are used, the swelling bulk material can expand under these devices, even when no chips are extracted from the silo. Appropriately arranged steam feed lines guarantee a good uniform steam distribution. Moreover, the shielding of the steam feed lines can prevent these lines from becoming clogged with bulk material.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawing by which

DETAILED DESCRIPTION OF THE PREFERRED EMBODIMENTS

Figure 1:
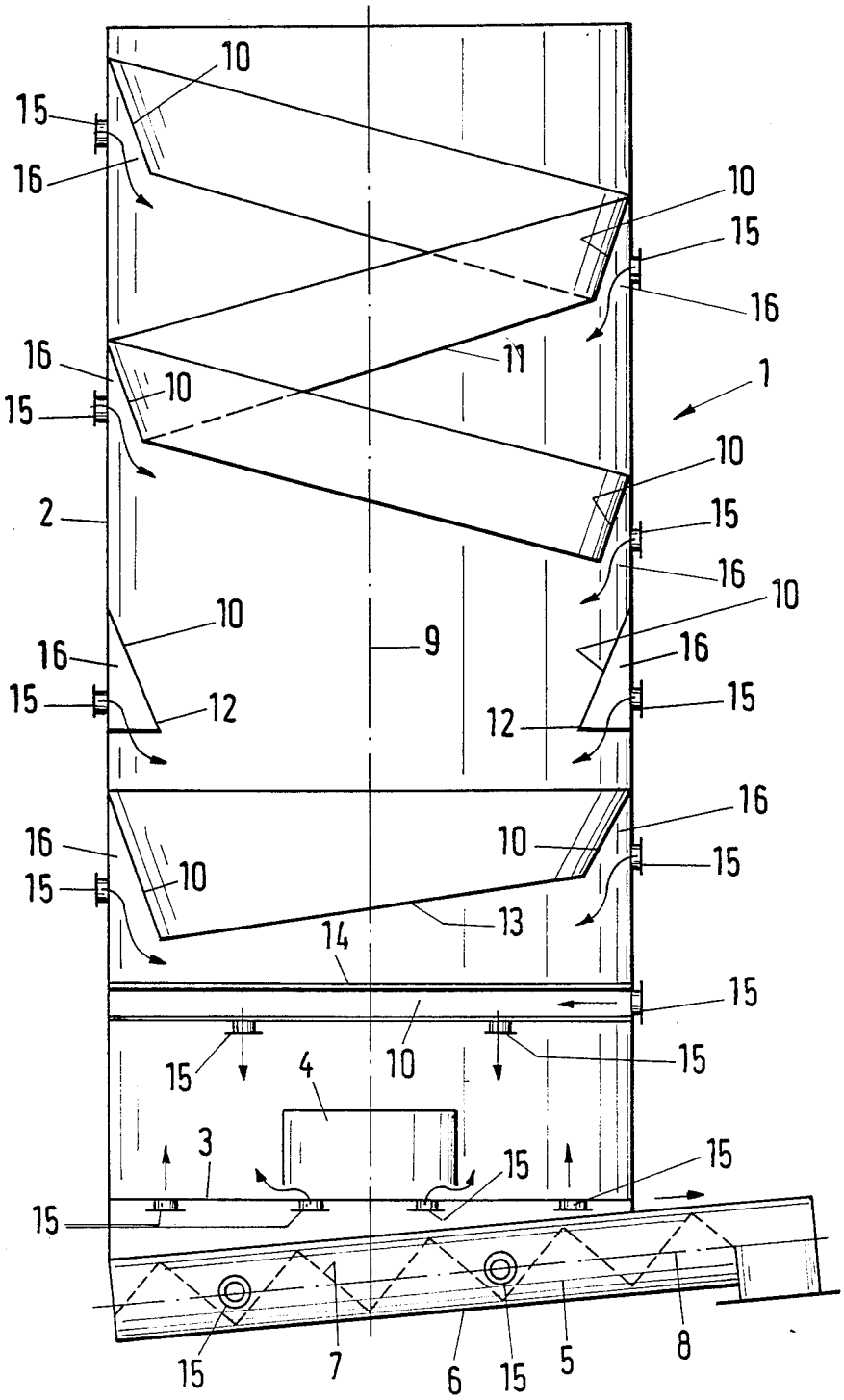
FIG. 1 shows a side view of a silo according to the invention.

The apparatus 1 according to the invention, shown in the drawing, is provided for the conditioning of bulk material, such as chips, fibers and the like, and can preferably be employed for the treatment of wood-chips which are used for the production of pulp for the making of paper or cardboard or of fibers for making fiberboards. The apparatus 1 has a silo 2 possessing on the inside, above the bottom 3, a clearing unit 4 which can be designed, for example, as a rotating body with radially projecting flexible drag arms (not shown) or as a rotary bottom (not shown). Such a cleaning unit 4 is for instance known from U.S. Pat. No. 3,666,117 and rotates above the bottom 3 of the silo 2 and pushes the bulk material through an orifice 29 in a trough 6 so that the bottom 3 is cleared and further bulk material can fall down from above. The orifice 29, under which a discharge screw conveyor 5 is located, is situated in the bottom 3 and is preferably congruent with the opening of trough 6. The discharge screw conveyor 5 includes the trough 6 which is located under the orifice in the silo bottom 3 and in which a conveyor screw 7 is mounted rotatably about an axis 8. The discharge screw conveyor 5 can appropriately be made so long that it extends over the entire diameter of the silo 2. FIG. 1 shows that the axis 8 extends not at right angles to the vertical mid-axis 9, but in such a way that the discharge screw conVeyor 5 ascends in the conveying direction (arrow). The angle of ascent can be approximately 3° to 15°, preferably approximately 5°.

Inside the silo 2 there can be various fittings which have guide surfaces 10 inclined obliquely downwards for the wood-chips to be introduced into the silo 2 from above and which can be designed as a helix 11, a wedge 12, a funnel 13 and a cross member 14 and as a truncated cone. The conical fittings 11 to 13 serve for the uniform damping of the wood chips and for simultaneous relief, to prevent bridges of the bulk material from forming in the silo 2 as a result of the swelling of the wood-chips. A uniform discharge of the bulk material is thus achieved.

For the conditioning of the wood-chips, which can preferably be carried out at low pressure and at a constant temperature of 92° C., but also under a high pressure of, for example 12 bar and at approximately 190° C., there are steam nozzles 15 which are arranged and distributed at various locations in the silo 2, so as to ensure a substantially uniform introduction of steam. In the present exemplary embodiment, the steam nozzles 15 are provided both on the side walls of the silo 2 in different, planes and at different distances from one another and on the cross member 14 and especially also on or under the silo bottom 3 on and the trough 6 of the discharge screw conveyor 5. At the same time, the steam nozzles 15 are arranged in such a way that they are largely shielded against the bulk material, in order to prevent clogging of the nozzles. For this purpose, the steam nozzles are preferably arranged on the silo 2 in the region of the spaces 16 which are located under the fittings 11 to 14 or which are jointly limited by their oblique guide surfaces 10. The lower steam nozzles above all are protected by sieve-shaped plates with conical orifices (FIG. 5).

Figure 5:
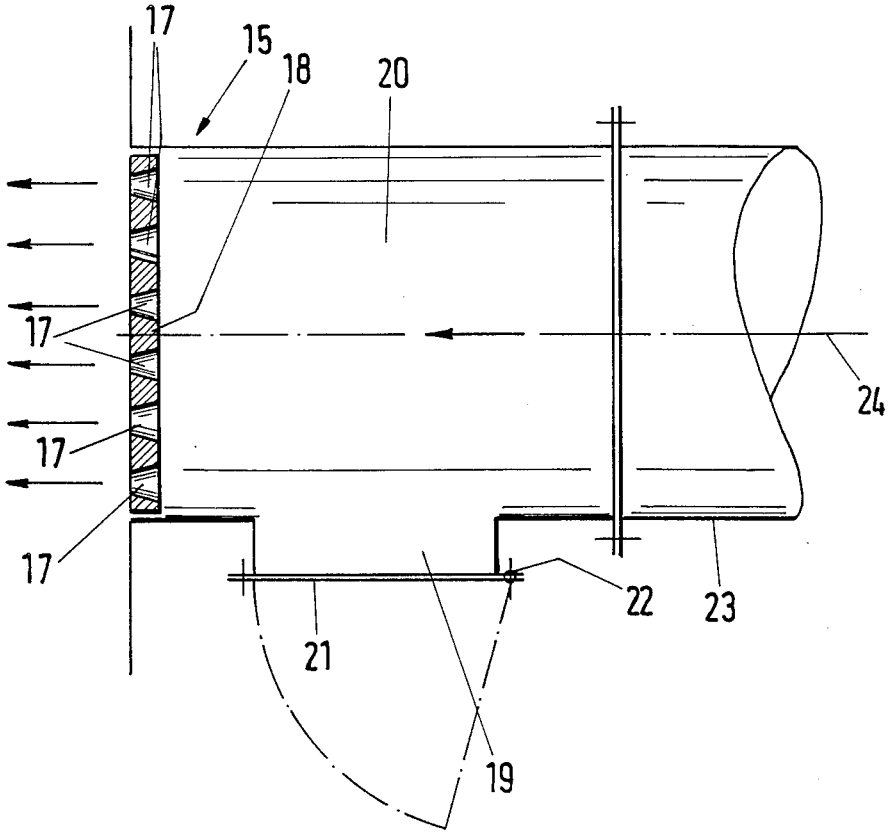
FIG. 5 shows a side view of a steam nozzle of the apparatus according to FIG. 1.

It can be seen from the exemplary embodiment of FIG. 5 that the steam nozzles 15 can have conical outflow holes 17 which taper conically in the direction of the steam flow (arrow). It can be beneficial, at the same time, to design the steam nozzle 15 so that it has several or a plurality of outflow holes 17 which can appropriately be provided in a sieve-shaped plate 18. The conical outflow holes 17 prevent the steam nozzles from being clogged with the bulk material, since the smaller opening cross-section of the conical or funnel-shaped outflow holes 17 faces the wood-chips, and therefore these cannot settle in the outflow holes 17.

It is expedient, furthermore, to equip the steam nozzles 15 with an inspection orifice 19, so that, as required, the inner space 20 of the steam nozzle 15 is accessible from outside. The inspection orifice 19 is closed by a releasable cover or flange 21 which is articulated pivotably on the steam nozzle 15 by means of an axle 22. Connected to that end face of the steam nozzle 15 located opposite the outflow holes !7 is a pipeline 23 through which the hot steam for the conditioning of the bulk material can be supplied. By means of the inspection orifice 19, it is possible to clean the inner space 20 and the outflow holes 17 from the inside, for example in order to remove impurities carried along or introduced by the steam supplied. As shown in FIG. 5, the cleaning orifice 19 is formed at right angles to the longitudinal axis 24 to the steam nozzle 15 and is arranged close behind the sieve plate 18, so that this sieve plate is easily accessible and can be cleaned easily.

Figure 2:
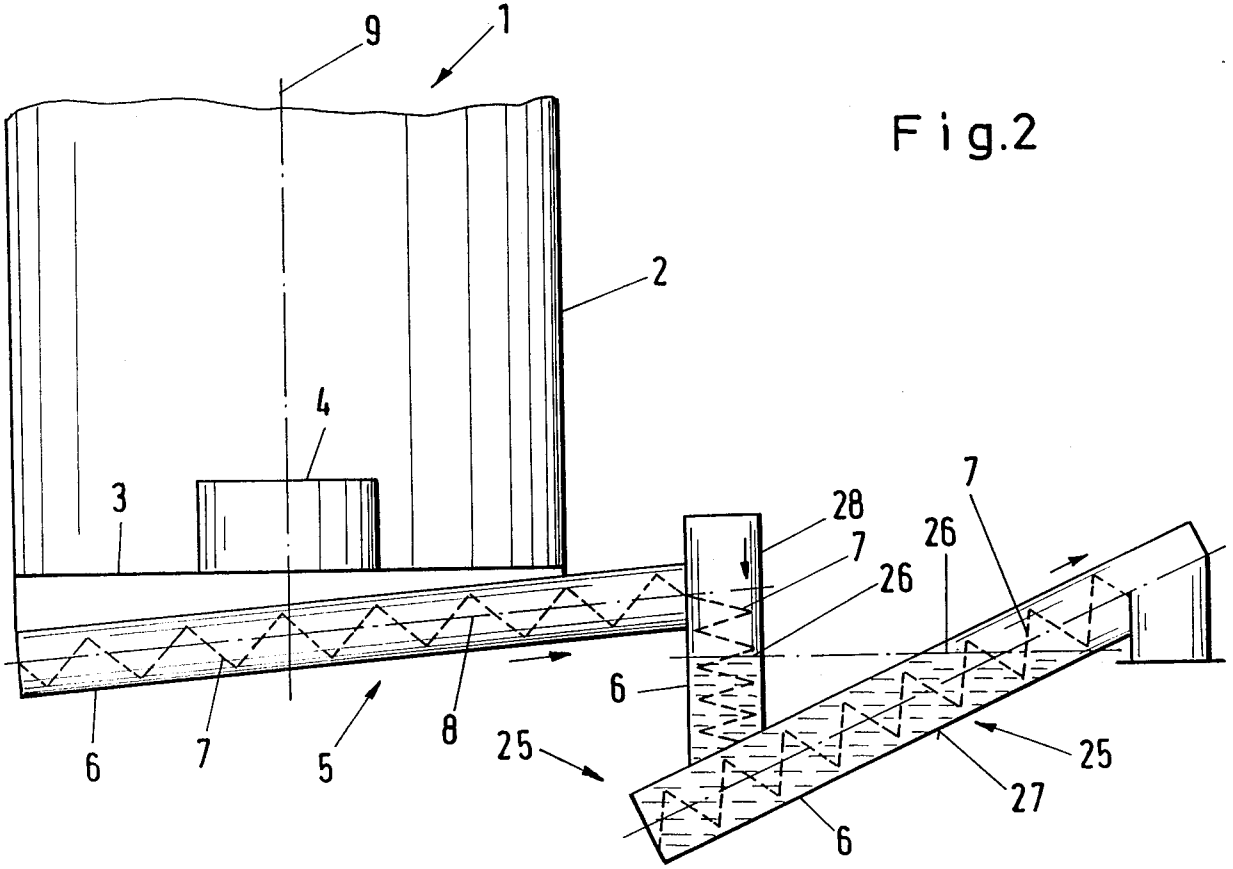
FIG. 2 shows a side view of the lower part of the silo according to FIG. 1, with an impregnating screw conveyor and with a rotor as a clearing unit.

It can be seen from FIG. 2 that the wood-chips, after being discharged from the silo 2, are conditioned additionally in an impregnating station 25. The bulk material is fed to the impregnating station via a discharge screw conveyor 5 which ascends obliquely upwards, in order to force steam out of the wood-chips as a result of compression. The impregnating station 25 contains an impregnating liquid 26 which is located in an impregnating screw conveyor 27 ascending obliquely in the conveying direction (arrow) and in a preferably vertical cross-conveyor 28 likewise designed as a screw conveyor. In the exemplary embodiment, the discharge screw conveyor 5 and the impregnating screw conveyor 27 are arranged at different angles of ascent, the ascent of the impregnating screw conveyor 27 appropriately being greater than the ascent of the discharge screw conveyor 5. The impregnating screw conveyor 27 can be arranged at an angle of approximately 5° to 60°, preferably approximately 25°, as indicated in the present exemplary embodiment.

Figure 3:
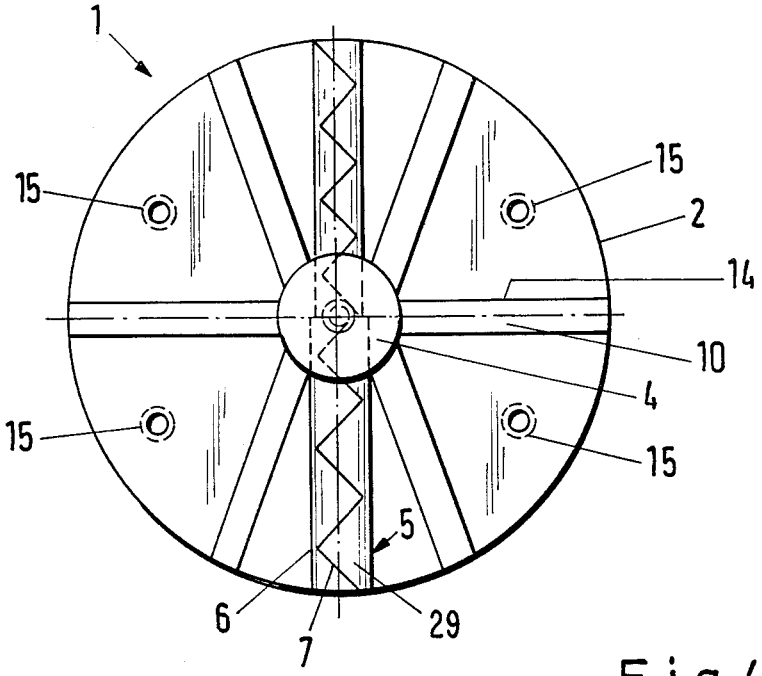
FIG. 3 shows a top view of the apparatus similar to that of FIG. 1, with a single discharge conveyor screw and with a rotary bottom as a clearing unit.
Figure 4:
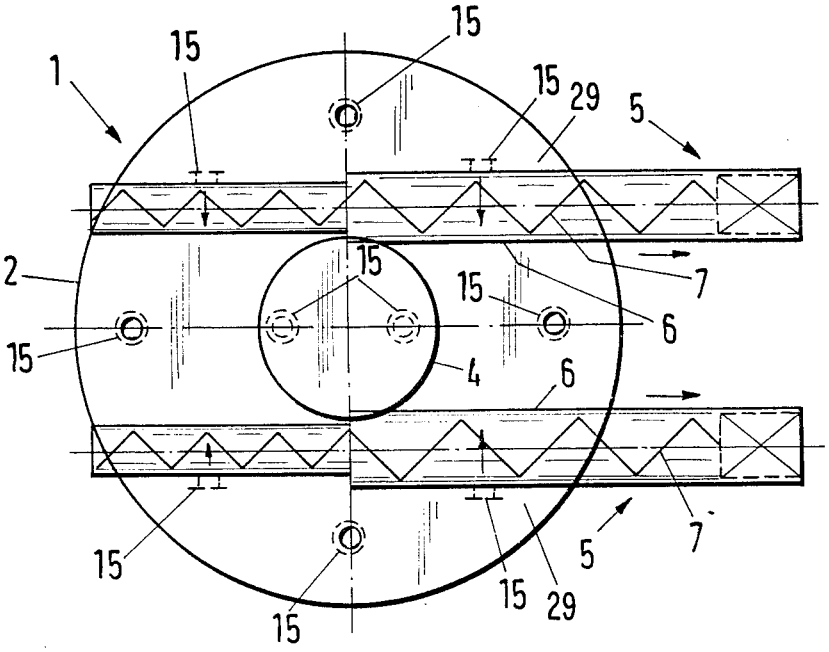
FIG. 4 shows the apparatus similar to that of FIG. 2, but with two parallel discharge conveyor screws.

In the exemplary embodiment illustrated in FIG. 3, there is only a single discharge screw conveyor 5 which extends diametrically over the silo 2 and its entire diameter. In the exemplary embodiment of FIG. 4 there are two parallel discharge screw conveyors 5 under the silo 2. This affords the advantage that the bulk material is discharged from the silo more uniformly and no deposits of bulk material can occur on the silo bottom 3, as can sometimes happen with only one discharge screw conveyor 5, when chips accumulate laterally next to the discharge screw conveyor 5 and cake together to form a wedge.

When two or more discharge screw conveyors 5 are used, two or more impregnating screw conveyors 27 and two or more cross conveyors 28 are appropriately likewise provided, so that altogether a uniform and high-quality conditioning of the chips can be achieved. By the use of two or more discharge screw conveyors 5, the retention time of the chips also becomes more uniform and steam losses are prevented. Moreover, several defibration mills can be fed independently of one another, thus saving considerable costs, because there is then no need for a separate silo for each defibration mill.

The fittings 11 to 14 prevent the bridging of the bulk material, because the downward movement of the bulk material on the silo wall is braked and incipient vaults collapse immediately as a result of the faster downward movement of the material in the middle of the silo. The fittings 11 to 14 can be arranged asymmetrically on the silo wall. The steam flowing into the silo 2 through the steam nozzles 15 can be distributed uniformly under the conical or wedge-shaped fittings 11 to 13 and flow out annularly, thereby ensuring the most efficient possible steam treatment of the chips. Since no bridges can occur in the bulk material, no channels form in the material either. The steam can pass through the bulk material slowly from the bottom upwards and is largely absorbed by the chips, so that there are virtually no steam losses and a high efficiency of steam treatment is achieved. Because the moisture is absorbed, the wood-chips swell, thereby increasing their volume, and they can enter the spaces 16 underneath the fittings 11 to 14, so that the increase in volume does not cause any blockage. Furthermore, the uniform steam distribution in the silo 2 is assisted, because the steam nozzles 15 are arranged at various locations in the silo 2, especially also on the screw troughs 6 and on the silo bottom 3 under the relief fittings 11 to 14. The conical design of the outflow holes 17 in the steam nozzles 15 ensures that the wood-chips do not penetrate into the narrowed outflow holes 17. Because of the funnel-shaped widening, the chips pass into the inner space 20 of the steam nozzle 15, so that the outflow holes 17 remain free and do not clog. Small chips and any impurities in the steam can easily be removed from the inner space 20 through the inspection orifice 19.

Because of the oblique ascent of the discharge screw conveyor 5 and because the wood-chips are relatively soft as a result of the absorption of moisture, a certain compression is generated in the discharge screw conveyor 5. The remaining steam is thereby forced out of the wood-chips. Subsequently, the wood-chips pass into the impregnating screw conveyor 27 which conveys them upwards somewhat more steeply. The chips are impregnated here. Since they have previously been squeezed or compressed, they readily absorb the impregnating liquid 26. The chips conditioned in this way, after leaving the impregnating screw conveyor 27, are delivered to a following defibration installation for further processing.

What is claimed is:

1. An apparatus for the conditioning of bulk material for the production of fibers or pulp for making paper, cardboard or fiberboards, comprising a silo with an inner cylindrical wall, a bottom defined within said silo and having at least one orifice, a clearing unit disposed within said silo, at least one discharge device arranged below said orifice, a plurality of fitting means for relieving said bulk material mounted above the lower third of said silo extending inwardly from the inner cylindrical wall and downwardly so that a space around a longitudinal axis of said silo remains free, said fitting means including lower flanges being adjacent to said cylindrical wall and forming spaces therebetween, and steam nozzles passing through said cylindrical wall leading to said spaces.

2. An apparatus as claimed in claim 1, wherein said discharge device is a screw conveyor.

3. An apparatus as claimed in claim 1, wherein at least one of said steam nozzles passes through said silo bottom leading upwardly into said silo.

4. An apparatus as claimed in claim 1, wherein at least one of said steam nozzles is mounted on said discharge device.

5. An apparatus as claimed in claim 1, wherein said steam nozzles have a conical bore tapering in the direction of steam flow.

6. An apparatus as claimed in claim 1, wherein said steam nozzles comprise a plate containing a plurality of outflow holes which taper conically in the direction of steam flow.

7. An apparatus as claimed in claim 1, wherein said steam nozzles comprise an inspection orifice and means for closing said orifice.

8. An apparatus as claimed in claim 7, wherein said means for closing said orifice is a releasable flange or cover.

9. An apparatus as claimed in claim 7, wherein said orifice is arranged transversely to the longitudinal axis of said steam nozzle.

10. An apparatus as claimed in claim 9, wherein said orifice is arranged at right angles to the longitudinal axis of said steam nozzle.

11. An apparatus as claimed in claim 1, further comprising at least one impregnating screw conveyor containing impregnating liquid for said bulk material.

12. An apparatus as claimed in claim 11, further comprising a cross-conveyor at least partially filled with said impregnating fluid, disposed between said discharge device and said impregnating screw conveyor.

13. An apparatus as claimed in claim 12, wherein said cross-conveyor is vertically disposed between said discharge device and said impregnating screw conveyor.

14. An apparatus as claimed in claim 11, wherein at least one of said discharge device and said impregnating screw conveyor ascends obliquely in the conveying direction.

15. An apparatus as claimed in claim 14, wherein said discharge device and said impregnating screw conveyor ascend at different angles.

16. An apparatus as claimed in claim 15, wherein the angle of ascent of said impregnating screw conveyor is greater than the angle of ascent of said discharge device.

17. An apparatus as claimed in claim 11, comprising at least two discharge screw conveyors which are independently operable.

18. An apparatus as claimed in claim 17, wherein said conveyors are disposed in parallel.

19. An apparatus as claimed in claim 1, wherein said fittings comprise funnel-shaped fitting, means wedge-shaped fittings, conical fittings, helical fittings or cross-members.

20. An apparatus as claimed in claim 1, further comprising transverse members provided in a lower part of said silo, and wherein steam nozzles are located below said transverse members.

* * * * *